US011426891B2

(12) United States Patent
Krautkramer et al.

(10) Patent No.: US 11,426,891 B2
(45) Date of Patent: Aug. 30, 2022

(54) PERFORATOR LUBRICATION SYSTEM

(71) Applicant: Kimberly-Clark Worldwide, Inc., Neenah, WI (US)

(72) Inventors: Robert E. Krautkramer, Combined Locks, WI (US); Matthew R. Wilson, Oshkosh, WI (US); James L. Baggot, Menasha, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 17/288,631

(22) PCT Filed: Dec. 3, 2020

(86) PCT No.: PCT/US2020/063037

§ 371 (c)(1),
(2) Date: Apr. 26, 2021

(87) PCT Pub. No.: WO2021/113461

PCT Pub. Date: Jun. 10, 2021

(65) Prior Publication Data

US 2022/0152858 A1 May 19, 2022

Related U.S. Application Data

(60) Provisional application No. 62/944,633, filed on Dec. 6, 2019.

(51) Int. Cl.
*B26D 7/08* (2006.01)
*B26D 1/22* (2006.01)
(Continued)

(52) U.S. Cl.
CPC ..... *B26D 7/088* (2013.01); *B26D 1/225* (2013.01); *B26D 1/405* (2013.01); *B26D 1/626* (2013.01); *B26F 1/20* (2013.01)

(58) Field of Classification Search
CPC . B26D 7/088; B26D 7/08; B26D 1/12; B26D 1/125; B26D 1/14; B26D 1/141;
(Continued)

(56) References Cited

U.S. PATENT DOCUMENTS 4,041,813 A 8/1977 Spencer
4,896,708 A * 1/1990 Dietz ..... B23D 61/02 144/369

(Continued)

FOREIGN PATENT DOCUMENTS

CN 104816330 B 3/2017
CN 106829585 B 2/2018
CN 209190863 U 8/2019
DE 19932244 A1 1/2001
EP 2641582 A1 * 9/2013 ..... A61J 3/078

OTHER PUBLICATIONS

Galli, Enrico, "Introduction to process and properties of tissue paper", The Navigator Company, 2017, https://www.tecnicelpa.com/files/20171013_EnricoGalli.pdf.

*Primary Examiner* — Evan H MacFarlane
(74) *Attorney, Agent, or Firm* — Kimberly-Clark Worldwide, Inc.

(57) ABSTRACT

The lubrication device delivers a lubricant to the perforating device which provides intermittently spaced cuts to a moving web, also referred to as perforations. The lubrication device includes a retaining member, a plenum, and a comb having a plurality of comb channels. The plenum and the plurality of comb channels are in fluid communication with one another and deliver a lubricant to the perforating device. Lubrication of the perforating device in this manner may improve knife life, perforation quality and web handling.

18 Claims, 6 Drawing Sheets

(51) Int. Cl.
*B26D 1/40* (2006.01)
*B26D 1/62* (2006.01)
*B26F 1/20* (2006.01)

(58) Field of Classification Search
CPC ..... B26D 1/143; B26D 1/1435; B26D 1/147; B26D 1/1475; B26D 1/20; B26D 1/205; B26D 1/22; B26D 1/225; B26D 1/34; B26D 1/345; B26D 1/36; B26D 1/365; B26D 1/38; B26D 1/385; B26D 1/40; B26D 1/405; B26D 1/62; B26D 1/626; B65H 35/00; B65H 35/0006; B65H 35/0073; B65H 35/008; B65H 35/0086; B65H 35/04; B65H 35/06; B65H 35/08; B26F 1/18; B26F 1/20; B26F 1/384; B26F 1/44; B26F 2001/4436; B26F 2001/4481; B26F 2001/449; B26F 2210/14; B23D 25/12; B23D 59/04; B23Q 11/12; B23Q 11/121; B23Q 11/122
See application file for complete search history.

(56) References Cited

U.S. PATENT DOCUMENTS

| | | | | |
|---|---|---|---|---|
| 5,246,088 | A | 9/1993 | Imai et al. | |
| 5,783,032 | A | 7/1998 | O'Callaghan et al. | |
| 5,894,775 | A * | 4/1999 | Brash | B26D 7/088 83/507 |
| 6,098,510 | A | 8/2000 | Hada et al. | |
| 7,526,984 | B2 | 5/2009 | Mitchell et al. | |
| 8,240,236 | B2 * | 8/2012 | Benz | B23D 55/082 83/171 |
| 9,381,661 | B2 * | 7/2016 | Ingole | B26D 1/405 |
| 9,862,112 | B2 * | 1/2018 | McCabe | B26F 3/02 |
| 2002/0117030 | A1 | 8/2002 | Gambaro et al. | |
| 2010/0167896 | A1 | 7/2010 | Hada et al. | |
| 2016/0250079 | A1 * | 9/2016 | Wada | B65H 39/14 493/345 |
| 2017/0252839 | A1 * | 9/2017 | Donisi | B23C 5/08 |
| 2017/0328818 | A1 | 11/2017 | Zhang et al. | |

* cited by examiner

PERFORATOR LUBRICATION SYSTEM

BACKGROUND

Methods and apparatuses intended to cut or produce lines of perforations in a moving target web are well known in the art. Conventional processes and machines have included a rotary knife roll and a stationary anvil. The rotary knife rolls have included removable and replaceable knives or blades, which have extended generally along the axial direction of the knife roll and have been distributed along the circumference of the knife roll with regular or irregular, intermittent spacing. In addition, the knife blades have been placed at an angle relative to the rotational axis of the knife roll. The placing of the blades on the roll at an angle has helped to reduce the impact loads generated during the cutting of the target web. In particular arrangements, it has also been necessary to skew the axis of rotation of the knife roll relative to the direction of the web movement past the knife roll. The amount of skewing has been suitably adjusted to obtain substantially straight cut along transverse cross-direction of the target web. Conventional techniques and devices are well known in the art, and suitable anvils and rotary knife rolls are available from commercial vendors.

Ordinary methods and apparatuses, however, have not provided desired combinations of efficiency and versatility, particularly when the cutting processes are operated with high web speeds. When conventional processes and machines have been arranged to cut a target web that is moving at high speeds past the anvil, the impact forces between the blade and the anvil have caused high rates of wear requiring a frequent changing of the knife and anvil blades. To reduce wear, the amount of interference between the knife and anvil blades has been set to relatively small values. The small values of interference help to reduce wear but can lead to areas of missing perforations in the web, due to vibrations in the components of the equipment and variations in the setup of the equipment. A poor quality in the perforations is not only poorly received by the final consumer using the product but can also lead to a poor operation of the manufacturing process. As a result, there has been a continued need for improved cutting systems that provide improved reliability and versatility, along with an improved and more reliable definition of the perforation line.

SUMMARY

The present inventors have now discovered a novel lubrication system for delivering a lubricant to an apparatus for cutting a line of perforations in a moving target web. The lubrication system reduces the friction between the knife blade and the anvil, reducing blade wear and extending blade life. Lubrication of the knife blade provides the dual benefit of reduced costs and increased operational efficiency. The lubrication system also enables the apparatus to be operated with sufficient interference between the knife and the anvil to produce consistent, high quality, perforations in the web, which reduces incidents of consumer complaints.

Generally, the present invention is directed to an apparatus for, and a method of, lubricating a knife blade which provides intermittently spaced cuts to a moving web, also referred to as perforations. The perforations may span the cross-machine direction (CD) of the web to form a line of perforations, which may be any given shape such as straight, curvilinear, or rectilinear, and the lines of perforations may be spaced apart from one another in the machine direction (MD) of the web to provide individual sheets that may be separated from one another by tearing along the lines of perforations. In this manner, the apparatus and method of the present invention are useful in both perforating a web and lubricating the knife used to form the perforations. Combining these processes, improves the knife life, perforation quality and web handling.

The apparatus and methods of the present invention are particularly well suited for lubricating a knife disposed on a rotating knife roll. In use, the rotating knife roll is positioned adjacent to a stationary anvil to provide an operative nip region there between. The anvil is generally retained in an anvil roll by an anvil retention assembly that has been adapted to deliver a lubricant to the anvil. Thus, the rotational positioning of the knife may be arranged to provide an operative cutting engagement between the knife and the anvil, thereby cutting the moving web at cut locations which are intermittently spaced along a machine direction (MD) of the target web, and to receive a lubricant from the anvil.

Accordingly, in one embodiment the present invention provides a lubrication system for supplying a lubrication fluid to a perforating device for imparting a plurality of perforations to a tissue web, the system comprising: a knife member; an anvil member; a lubrication device comprising a retaining member shaped to retain the knife or the anvil member, a plenum for receiving a quantity of lubricant and a comb having a plurality of comb channels, wherein the plenum and the plurality of comb channels are in fluid communication with one another; a receptacle for storing and dispensing a lubricant to the lubrication device; a lubricant disposed in the receptacle; and a pump.

In other embodiments, the present invention provides a lubrication system for supplying a lubricant to a perforating device for imparting a plurality of perforations to a tissue web, the system comprising: a rotating knife roll having at least one knife disposed thereon; an anvil roll having an anvil retention assembly comprising a retaining member having a plenum for receiving a quantity of lubricant and a comb having a plurality of comb channels, wherein the plenum and the plurality of comb channels are in fluid communication with one another; an anvil retained by the anvil retention assembly; a receptacle for storing and dispensing a lubricant; a lubricant disposed in the receptacle; and a pump.

In another embodiment, the present invention provides an anvil retention assembly comprising: a retaining member having a longitudinal, a transverse and a radial direction, a first and a second end, an inlet port, a plenum and a channel in fluid communication with the inlet port and the plenum and an opening extending transversely through the retaining member and shaped to receive a fastener; and a comb having a longitudinal, a transverse and a radial direction, the comb having a plurality of radially extending channels in fluid communication with the plenum.

In yet other embodiments the present invention provides a method of administering a lubricant to a perforating device comprising the steps of: providing a rotating knife roll having at least one knife disposed thereon; providing an anvil roll having at least one anvil retention assembly disposed thereon, the at least one anvil retention assembly comprising a plenum for receiving a quantity of lubricant and a comb having a plurality of comb channels in fluid communication with the plenum; retaining an anvil in the at least one anvil retention assembly; positioning the knife roll and anvil roll to provide an operative nip region therebetween; providing a lubricant to the anvil retention assembly; distributing the lubricant to at least a portion of the at least one anvil to provide a lubricated anvil; rotating the knife roll; and contacting the lubricated anvil with a rotating knife to provide a selected cutting interference therebetween, whereby the lubricant is transferred to the knife.

By incorporating its various aspects and features, alone or in desired combinations, the method and apparatus can provide lubrication via the anvil to the cooperating knife when the knife and anvil contact or otherwise engage each other in the nip region between the knife and anvil rolls. In the desired arrangements, the method and apparatus can lubricate the knife and facilitate more reliable and consistent perforating or other cutting operation. In addition, the apparatus can require less maintenance, reduce costs and increase operational efficiency.

DETAILED DESCRIPTION

Figure 1:
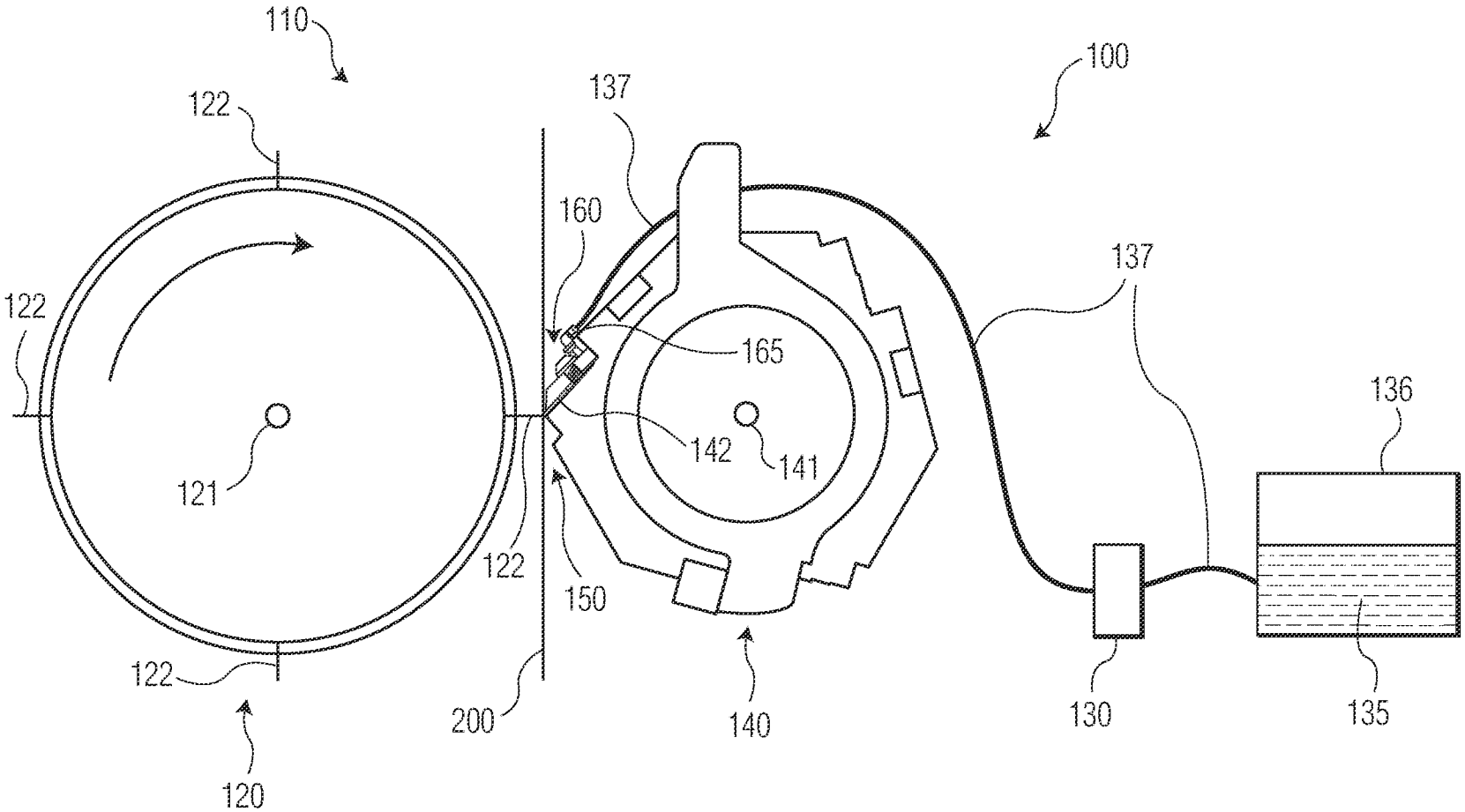
FIG. 1 is a schematic view of a lubrication and perforating system.

With reference to FIG. 1, the present invention is generally directed to a system 100 for lubricating a perforating apparatus 110 comprising a knife roll 120 and an anvil roll 140. The system 100 is well suited for cutting a line of perforations in a moving target web 200. It should be appreciated however, that the instant apparatus and methods are well suited for a wide range of manufacturing systems that include high-speed cutting of selected web materials. In a particularly preferred embodiment, the apparatus and methods of the present invention are useful in the manufacture of tissue webs and products. For example, the present invention may be employed in the construction of facial tissue, bath tissue, wipes, toweling, disposable personal care articles, disposable absorbent articles, or the like.

The target web can include one or more selected materials. The target web can include a single layer or multiple layers. The multiple layers may differ from one another or may be substantially the same. Optionally, the target web may include a combination of one or more additional webs of material. Any suitable web material may be employed. In a particularly preferred embodiment, the web material is a fibrous tissue web having a low basis weight, such as from 10 to 100 grams per square meter, high bulk, such as greater than 3 cubic centimeters per gram, and comprising one or more plies.

In use, the web 200 to be perforated travels though the perforating apparatus 110 in a machine-direction ("MD") which extends transversely to the cross-machine direction ("CD"). For the purposes of the present disclosure, the MD is the direction along which a particular component or material is transported length-wise along and through a particular, local position of the apparatus and method. The CD is aligned perpendicular to the MD along the local plane of the material targeted for work and can lie generally parallel to the local horizontal. As the web 200 passes through the apparatus 110 the web 200 is intermittently cut to provide lines of perforations. Generally, perforation of the web 200 is achieved by a cutting action as the web 200 passes through a nip 150 between a knife blade 122 and an anvil 142.

As discussed herein the knife blade generally refers to a blade having alternately spaced teeth and notches across a portion of the blades leading edge, while the anvil generally has a substantially constant height along its length. One skilled in the art will appreciate, however, that the position of the knife blade and the anvil may be switched without affecting the performance or operation of the system and apparatus. For example, the rotating roll may be provided with one or more anvils and a stationary roll may be provided with a knife blade that is contacted by the one or more rotating anvils. In such a configuration, a lubricant may be provided to a knife blade mounted to the stationary roll and subsequently transferred to the knife blade upon interference of the anvil and knife blades as they cut a web passing therebetween. For simplicity however, the present invention will generally be described with reference to the figures, which illustrate an embodiment in which the knife blades are mounted to a rotating knife roll and the anvil mounted to a stationary roll and provided with a means for delivering a lubricant to the anvil.

In addition to cutting the web, the system 100 is configured to dispense a lubricant 135 to the anvil 142 and subsequently to the knife blade 122 as the knife blade 122 interferes with the anvil 142 and cuts the web 200. Examples of lubricants useful in the present invention include, for example, polyethers, glycol, polyolefins, silicone, fluorocarbons, grease, graphite, animal oils, vegetable oils and mineral oils. Particularly preferred are mineral oil and still more preferably white mineral oil. By "white mineral oil," it is herein intended very highly refined oils which consist entirely of saturated components, all aromatics having generally been removed by treatment with fuming sulfuric acid or by selective hydrogenation.

A lubricant is delivered to the anvil 142 and subsequently to the knife blade 122 by a perforating and lubricating system 100, such as illustrated in FIG. 1. The lubricating system 100 includes an anvil retention assembly 160 configured to retain the anvil 142 and deliver a lubricant 135 to at least a portion of the retained anvil 142. The system further includes a lubricant container 136 configured to retain and store lubricant 135 and which is connected to, and supplies, lubricant 135 to the anvil retention assembly 160. A pressure source 130, such as pump, is connected to, the lubricant container 136 to deliver the lubricant 135 to the anvil retention assembly 160. Generally, a conduit 137, such as flexible tubing, connects the pressure source 130, the lubricant container 136 and the anvil retention assembly 160.

In certain instances, the pressure source may be a pump, particularly a suction feed pump (also known as a piston pump). Particularly preferred are piston pumps capable of pumping small flows of either mineral or synthetic oil (food grade) to a single machinery injection point. The system may further comprise a control mechanism for controlling the pressure source. The control mechanism may include a flow control for the pump, which controls the delivery the rate (increase or decrease) of lubricant to the anvil retention assembly.

With further reference to FIG. 1, the pump 130 is connected to a port 165 disposed on the anvil retention assembly 160 via conduit 137. While FIG. 1 illustrates only a single port 165 and conduit 137, the invention is not so limited. Preferably, the system comprises multiple conduits for delivering lubricant across the cross-machine direction length of the anvil. In this manner, the anvil retention assembly may be provided with multiple ports, where each port is coupled to a length of lubricant delivery conduit. The configuration of the multiple ports and the delivery of lubricant to the anvil retention assembly and subsequently the anvil will be discussed in more detail below.

With continued reference to FIG. 1, the system for lubricating a knife blade and intermittently cut a moving target web 200 includes rotating a knife roll 120 having at least one knife blade 122 positioned relative to one another to provide an operative nip 150 therebetween. A web 200, such as a continuous web of tissue, is moved at a selected web speed through the nip 150. Operative web transport mechanisms or systems are well known in the art and will not be further described here. As the web 200 passes through the nip 150 created by interference of the knife blade 122 and its cooperating anvil 142, the moving web 200 is cut in locations which are intermittently spaced along the MD of the web 200. Each cut can be distributed in a predetermined pattern or array. In certain instances, the cuts form an individual line or other individual array of perforations which extends along the CD of the web and can be produced at predetermined cut locations that are intermittently spaced apart at substantially non-contiguous areas or regions along the MD web.

The nip 150 between the opposed rolls 120, 140 can include a variable nip gap distance or a substantially fixed, nip gap distance. Desirably, the method and apparatus can be configured to provide a selected interference engagement between a knife and a cooperating anvil. In a particular aspect, the method and apparatus can be configured to operatively provide and maintain a selected amount of cutting interference or "overlap" distance along the respective radial directions extending between the knife blade 122 and its cooperating anvil 142 when the knife blade 122 and its cooperating anvil 142 are in the nip 150 during the rotating of the knife roll 120. When properly selected and adjusted, the amount of cutting interference can provide a neat, "clean" perforating or other cutting operation, which is reliably and consistently produced. In a particular feature, the cutting interference distance can be at least a minimum of about 0.1 mm. In other aspects, the interference distance can be up to a maximum of about 0.38 mm, or more. The interference distance can alternatively be up to about 0.25 mm and can optionally be up to about 0.15 mm to provide desired performance.

The knife roll 120 has an axially extending, rotational shaft member 121, and an operative axis of rotation. The anvil roll 140 also has an axially extending shaft member 141 for mounting the anvil roll 140. Preferably the anvil roll is stationary in operation, but optionally may have an operative axis of rotation and be rotated in use. In still other instances, the anvil roll may be stationary in operation, but may be rotated periodically to present a new anvil for interacting with a rotating knife.

The knife roll 120 can have the general form of a cylinder with a substantially circular cross-section, a lengthwise, axial direction, a circumferential direction and a radial direction. The knife roll 120 generally has one or more knife blades 122 that are distributed generally on and about the outer surface of the cylinder. As representatively shown, the knife roll 120 has an outer peripheral surface, and can be provided with selected plurality of knives 122, which may be arrayed or otherwise arranged in any operative distribution along the outer periphery of the knife roll.

The individual knives may have any operative configuration, and any operative array may be employed. The array of knives may be distributed in a pattern that is regular, irregular, linear, curvilinear, nonlinear, or the like, as well as combinations thereof. Techniques for constructing the individual knives and the distributed pattern arrays are conventional and well known in the art. Suitable techniques for operatively mounting and securing the knives on the knife roll are also conventional and well known in the art. The pattern of knives can be configured to have any operative distribution. For example, the pattern may be intermittent (e.g. arranged in two or more discrete segments) along the circumferential-direction of the knife roll. Additionally, the pattern may be intermittent, arranged in two or more discrete segments, or substantially continuous along the axial direction of the knife roll.

The individual knives can be irregularly or substantially regularly spaced along the circumferential-direction of the knife roll in any desired, operative distribution pattern. Such distributions of knives are conventional and well known. The individual knives are operatively secured to the knife roll, and can have any operative, size, shape and/or cross-section. In desired arrangements, the knives are detachable, removable and replaceable, with respect to the knife roll. For example, each knife can be operatively bolted and/or clamped to the knife roll. Each knife can extend radially above the peripheral surface of the knife roll by an operative distance. Each individual knife, however, may or may not extend parallel to the rotational axis or axial direction of the knife roll. In desired configurations, each knife may extend circumferentially and axially in an operative, generally helical path along the outer periphery of the knife roll.

Each knife can have a substantially straight or substantially constant-height profile along its generally axial, lengthwise dimension; or can have a contoured profile. The contoured profile of the knife may be notched or otherwise configured to provide a series of cutting-teeth elements that are configured to cut the target web with a desired perforation or other cutting pattern. The cutting-teeth elements can be intermittently spaced along the generally axial dimension of the knife in a desired pattern. The spacing pattern of cutting-teeth elements may be irregular or substantially regular, as desired. The cutting-teeth elements extend radially away from the periphery or peripheral surface of the knife roll and are intermittently spaced along the generally axial direction/dimension of the knife. Any operative pattern of intermittent spacing may be employed, and the intermittent spacing of cutting-teeth elements may be irregular or substantially irregular, as desired. Each perforation pattern can be configured to extend generally along the cross-direction; and a spaced-apart series of perforation patterns can be intermittently located in a regularly or irregularly occurring sequence along the machine-direction of the target web. Since a discrete amount of interference between the knife and anvil is typically required for reliable, consistent cutting, the knives are desirably configured to operatively bend or flex to absorb or otherwise accommodate impact loads that might be encountered during ordinary use.

Suitable knife rolls and knives can be produced and configured in a conventional manner and are available from commercial vendors. For example, suitable knife rolls may be obtained from Paper Converting Machinery Company (PCMC), a business having offices located in Green Bay, Wis., U.S.A.; and from Fabio Perini SpA., a business having offices located in Lucca, Italy. Suitable knives may be obtained from The Kinetic Company, a business having offices located in Greendale, Wis., U.S.A.

With continued reference to FIG. 1, the anvil roll 140 can have the general form of a cylinder with a substantially circular cross-section, a lengthwise, axial direction, a circumferential direction and a radial direction. As representatively shown, the anvil roll 140 is provided with at least one anvil 142. In other embodiments the anvil roll may comprise a plurality of anvils, which may be arrayed or otherwise arranged in any operative distribution along the outer periphery of the anvil roll. The individual anvils can have any operative, size, shape and/or cross-section. The anvil roll 140 has a shaft portion 141, and can be operatively mounted for rotation by employing a suitable support structure in a conventional manner that is well known in the art.

The anvil roll 140 has at least one anvil 142, which may be detachable, removable and replaceable, with respect to the anvil roll. Preferably, as illustrated in FIG. 1, the anvil 142 is clamped to the anvil roll 140 by an anvil retention assembly 160. The anvil retention assembly 160 may be mounted lengthwise of the anvil roll 140 and parallel to the longitudinal axis of the anvil roll 140. Although, it may be preferable that the anvil retention assembly be mounted parallel to the longitudinal axis of the anvil roll, the holder may be disposed on the roll in a linear, curvilinear, or nonlinear fashion. Further, the holder may be configured such that the anvil can, for example, operatively bend or flex to absorb or otherwise accommodate impact loads that might be encountered during ordinary use.

In certain preferred embodiments the anvil roll may comprise a plurality of anvil retention assemblies, such as four or more assemblies. For example, the anvil roll may comprise four holder assemblies radially spaced 90 degrees apart from each other, although it may be desirable according to the lengths of web to be cut to utilize only one or more up to a total of normally no more than eight. In the various configurations of the method and apparatus, the number of anvils on the employed anvil roll may or may not equal the number of knives on the employed knife roll.

The pattern of anvils can be configured to have any operative distribution. The pattern may be intermittent, arranged in two or more discrete segments, along the circumferential-direction of the anvil roll. Additionally, the pattern may be intermittent, such as by being arranged in two or more discrete segments, or substantially continuous along the axial direction of the anvil roll. The anvils can be irregularly or substantially regularly spaced-apart along the circumferential direction of the anvil roll in any desired, operative distribution pattern.

As illustrated in FIG. 1, the anvil 142 generally extends radially beyond and above the outer peripheral surface of the anvil roll 140 by an operative height distance. In desired arrangements, the anvil may have a substantially straight or substantially constant-height profile along its lengthwise extent along a generally axial direction of the anvil roll. The anvil may or may not extend parallel to the rotational axis of the anvil roll; may extend in an operative, generally helical path along the outer periphery of the anvil roll.

Figure 2A:
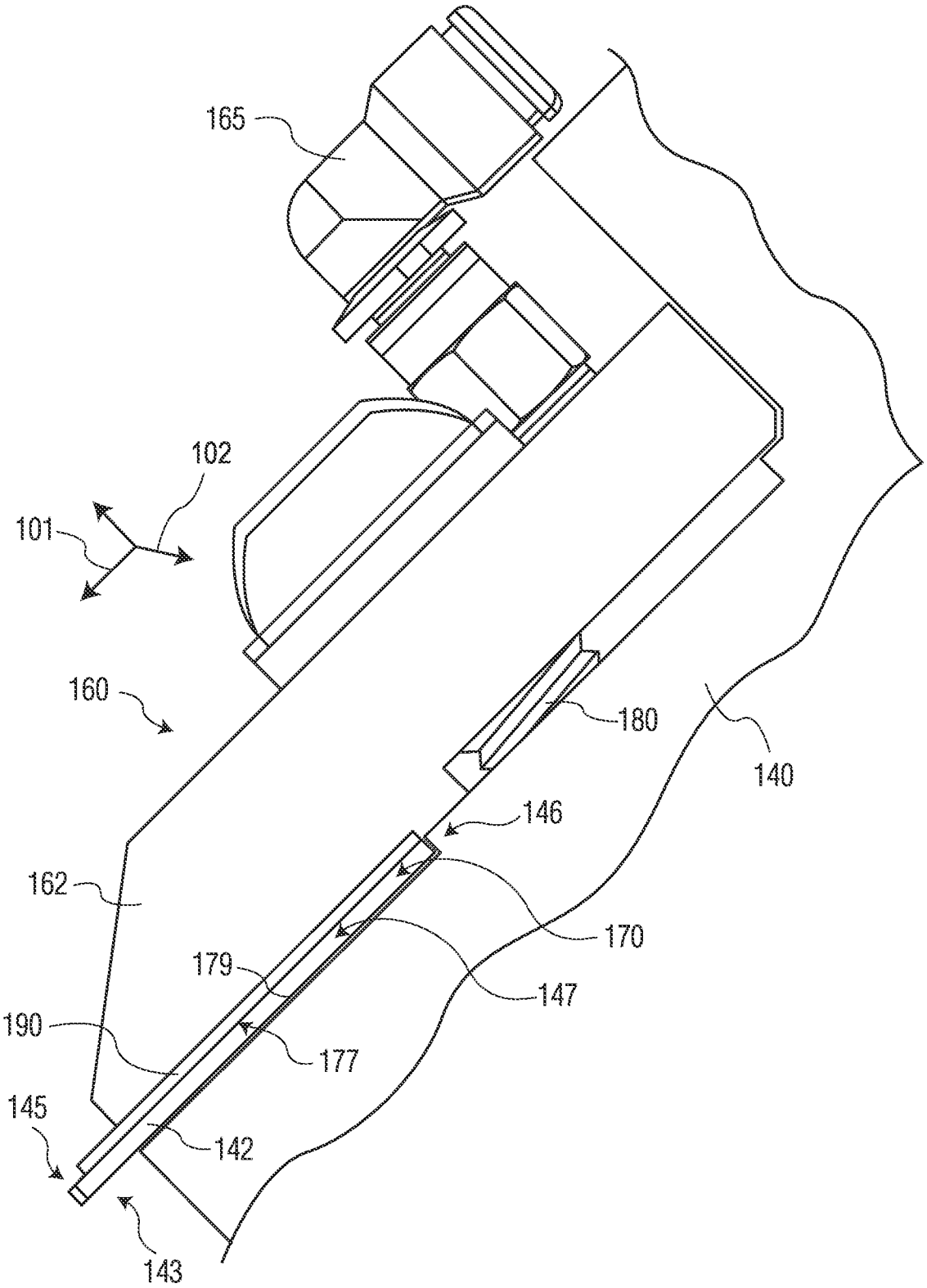
FIGS. 2A and 2B are side and cross-sectional views, respectively, of an anvil retained between an anvil retention assembly and an anvil roll.
Figure 2B:
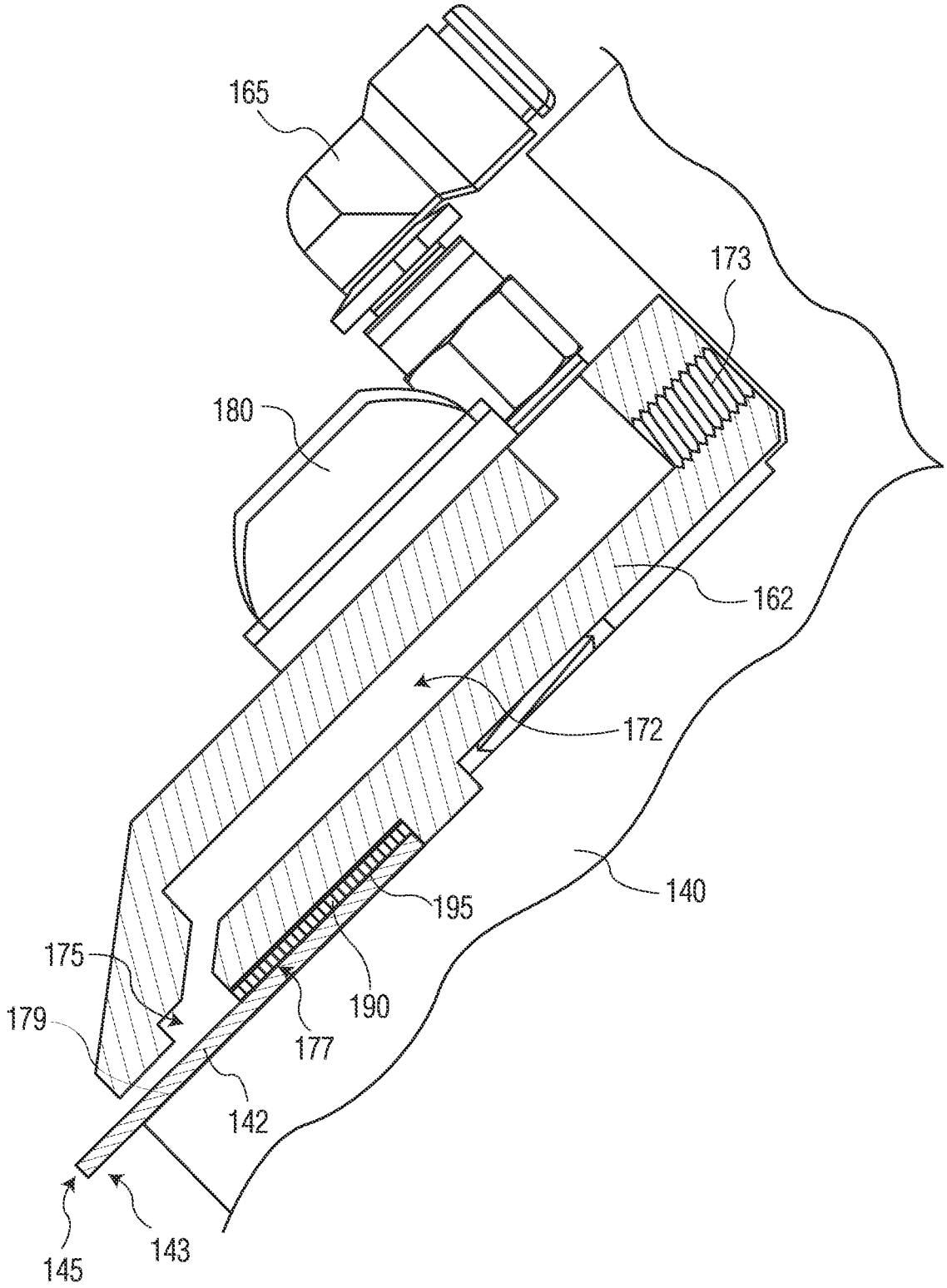

Turning now to FIGS. 2A and 2B, the anvil retention assembly 160 will be described in more detail. The assembly 160 is configured to receive and retain an anvil 142 against a surface of the anvil roll 140. The anvil, which may normally be made of suitable steel in a flat strip, has a distal tip 145 that may be hardened, beveled and/or sharpened. The opposite end 146 of the anvil 142 is disposed in a slot 170 formed by the anvil retention assembly 160 and the anvil roll 140. The slot generally extends longitudinally 102 along the roll and is sized to receive the anvil. The slot 170 has an upper surface 177, which in the illustrated embodiment is partially formed by the comb 190 and a lower surface of the retaining member 162. The slot 170 has a lower surface 179 formed by the anvil roll 140. The upper and lower surfaces 177, 179 may be substantially parallel or may be tapered to improve retention of the anvil therein.

While in the embodiment illustrated in FIGS. 2A and 2B, the anvil is in direct contact with the anvil retention assembly and the comb, the invention is not so limited. In alternative embodiments the anvil retention assembly may be provided with one or more pieces of a compressible and/or elastomeric material to reduce vibration of the anvil or to facilitate a fluid-tight seal between the anvil retention assembly and the anvil. For example, a compressible and/or elastomeric material may be interposed between one or more components of the anvil retention assembly or between the anvil retention assembly and the anvil.

In one embodiment, an elastomeric material having a plurality of slits disposed therein may be disposed between the retaining member and the comb. In such an embodiment the slits may be registered with the plenums to facilitate fluid communication between the plenum and one or more comb channels. In other embodiments, a compressible and/or elastomeric material may be interposed between the anvil and the anvil roll. The elastomeric material can extend substantially co-extensively with the clamped portion of anvil, extending along all or a portion of the length of the anvil. Suitable elastomeric and/or compressible material include materials having a high damping coefficient such as, for example, polyurethane, rubber, silicone or neoprene.

Generally, the slot 170 extends substantially across the longitudinal axial dimension 102 of the anvil roll 140, although the length may be varied depending on the length of the anvil to be retained. It will also be appreciated that in utilizing the present invention an anvil length less than the length of the slot can be carried within the anvil retention assembly. Thus, the present invention may be adapted to mount anvils of varying lengths in the anvil retention assembly according to the requirements of particular perforation widths without being compelled to use too long an anvil. For example, a 10-inch long anvil can be mounted within a 20-inch long anvil retention assembly when the web to be cut is less than 10 inches in width.

With continued reference to FIGS. 2A and 2B, the anvil 142 is rigidly supported by the anvil roll surface forming the bottom portion of the slot 170. The anvil 142 is clamped against the anvil roll surface by the anvil retention assembly 160 using a fastener 180, such as a threaded bolt. The anvil 142 extends radially outward from the assembly 160 to provide an extending free or unsecured outer unclamped portion 143. In this manner the anvil 142 comprises an unclamped portion 143 and a clamped portion 147.

The anvil 142, which may have a cross-sectional thickness of about 1.00 to about 2.20 mm, is seated in the slot 170 and retained by tightening of a fastener 180. When the fastener 180 is tightened the assembly 160 is urged towards the anvil roll 140, clamping the anvil 142. In this manner the assembly may accommodate anvils having a wide range of thicknesses and does not rely solely upon frictional engagement to retain the anvil. Further, using a fastener to apply a clamping force, the anvil may be retained in the anvil assembly and a fluid-tight seal may be formed between the anvil and the anvil assembly. As will be discussed further below, the fluid-tight seal facilitates delivery of the lubricant to the surface of the anvil in a controlled and uniform manner.

In certain preferred embodiments, such as that illustrated in FIGS. 2A and 2B, the fastener 180 does not pass through the anvil 142. Rather, the fastener 180 creates a direct connection between the anvil roll 140 and the anvil retention assembly 160. In other embodiments, however, the anvil may comprise one or more holes through which the fastener may be passed. In still other embodiments the anvil may have a plurality of spaced apart holes shaped to receive one or more retaining pins disposed on either the anvil roll or the anvil retention assembly. The holes may be constructed with diameters very close to the diameters of the pins such that frictional engagement further aids in retention of the anvil.

A first group of fasteners or bolts, one of which is shown in FIGS. 2A and 2B as bolt 180, is fitted into holes in the retaining member 162 portion of the anvil retention assembly 160. The fasteners 180 are threaded into the anvil roll 140 so that the tightening bolt 180 urges the retaining member 162 towards the anvil roll 140 to clamp and retain the anvil 142 within the slot 170.

With continued reference to FIGS. 2A and 2B, the anvil 142 is disposed in the slot 170 and extends radially therefrom. The anvil 142 may be disposed in the slot 170 such that it has a straight or substantially constant-height profile along its lengthwise extent. A portion of the anvil 142 is clamped between the assembly 160 and the surface of the anvil roll 140.

Lubricant is delivered to the anvil retention assembly 160 via an inlet port 165, which may be disposed on an upper, outer surface of the assembly 160 to facilitate access. The inlet port 165 is in fluid communication with a channel 172, shown in the cross-sectional view of FIG. 2B. The channel 172 may have any cross-section shape and size and in certain preferred embodiments has a circular cross-section. The channel 172 may be formed by drilling or boring a circular hole retaining member 162 in the axial direction. The channel 172 may be sealed with a plug 173 inserted into the rear of the retaining member 162.

The channel 172, which extends generally in the axial direction, is in fluid communication with a reservoir 175, also referred to herein as a plenum. The plenum 175, which generally has a length, width and depth dimension, may extend longitudinally along a portion of retaining member 162. The plenum 175 may be formed by removing a portion of the retaining member 162 to form a recess having the desired volume. In use, the plenum may be partially filled, or completely filled, with a lubricant. The lubricant may be pumped under pressure through the channel to the plenum, filling the plenum and pressurizing the system. Accordingly, in certain instances, the plenum may be sized to maintain sufficient pressure in the lubrication delivery system, such as from about 0.007 to about 0.07 bars, such as from about 0.01 to about 0.05 bars.

With continued reference to FIGS. 2A and 2B, a comb 190, which comprises a plurality of teeth 192 spaced apart from one another with openings 194 (shown in FIGS. 3 and 4), also referred to herein as channels, disposed therebetween. The comb 190 is generally disposed between the retaining member 162 and the anvil 142, however, one or more additional materials, such as an elastomeric and/or compressible material, may be disposed on the comb and the retaining member or anvil.

In certain embodiments an elastomeric material, such as rubber or a polyurethane plastic, may be located within a recess of the retaining member shaped to receive the comb. In this manner the elastomeric material is positioned between the comb and the retaining member and may be provided with a plurality of apertures, such as holes or slits, to permit the flow of lubricant from the plenum to the comb. In other embodiments, an elastomeric member, such as rubber or a polyurethane plastic, may be located between the anvil and the anvil roll. In such embodiments the elastomeric material may extend substantially along the length of anvil, or only along a portion of its length.

The openings 194 between the comb teeth 192 create channels through which lubricant may flow from the plenum 175 to the anvil 142. The number and size of the channels or openings may be designed to provide the system with the desired pressure and flow rates of lubricant. In certain embodiments, the channels may have a depth (measured in the radial direction) from about 0.50 to about 3.00 mm, such as from about 1.0 to about 2.0 mm, a width from about 0.50 mm to about 1.00 mm, such as from about 0.70 to about 0.90 mm and a z-direction height from about 0.10 to about 0.50 mm, such as from about 0.20 to about 0.30 mm. In this manner, individual channels may have a volume from about 0.05 to about 1.50 $mm^3$.

The channels may be similarly shaped, or they may be differently shaped. In a particularly preferred embodiment, the channels are all similarly shaped and have a substantially rectangular cross-section and a width from about 0.70 to about 0.90 mm. Further, the channels may be disposed along a length of the comb, such as a portion having a length from about 50 to about 100 mm, such that from about 50 to about 75 regularly sized and shaped, equally spaced apart channels are disposed along the length.

Further detail regarding the orientation and configuration of the channel 172, plenum 175 and comb channels 194, is further illustrated in FIGS. 3, 4, 5A and 5B. The retaining member 162 may be provided with a plurality of individual inlet ports 165 longitudinally spaced apart from one another. The number of inlet ports may vary depending on the size of the retaining member, anvil, and the desired flow rates and pressures.

Each of the inlet ports 165 are in fluid communication with a channel 172, which in turn is in fluid communication with a plenum 175. Accordingly, in the illustrated embodiment, each inlet port delivers lubricant to a single channel, which in turn, delivers lubricant to a single plenum. A comb 190 having a plurality of comb channels 194 is disposed below the plenum 175. Lubricant provided to the plenum flows outwardly therefrom through the comb channels to the anvil.

Figure 3:
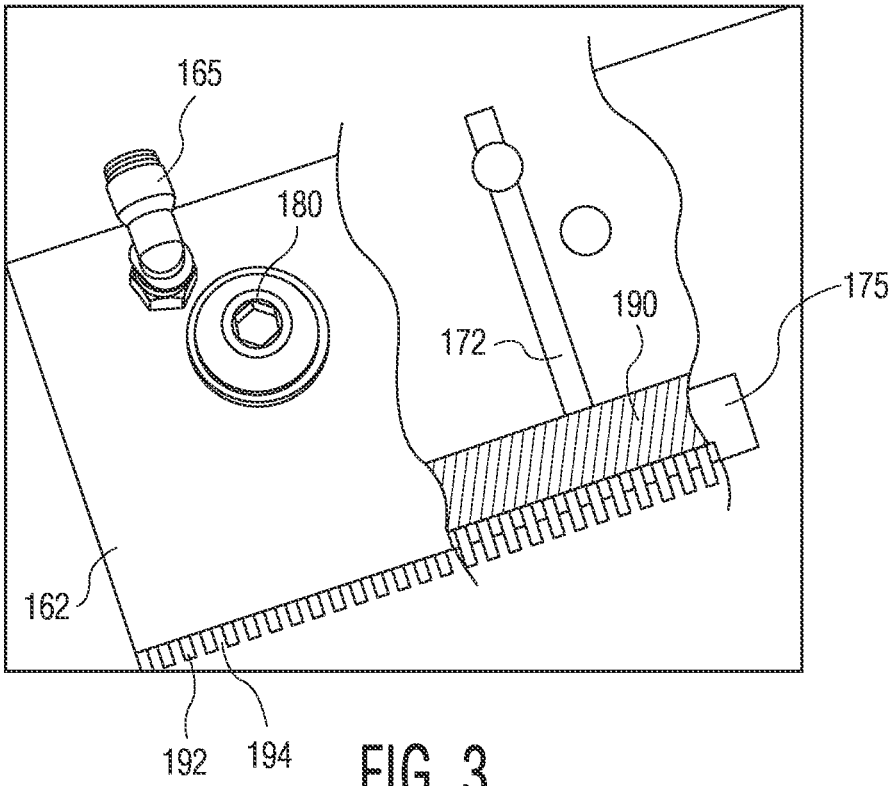
FIG. 3 is a top view showing three different elevations of an anvil retention assembly.
Figure 4:
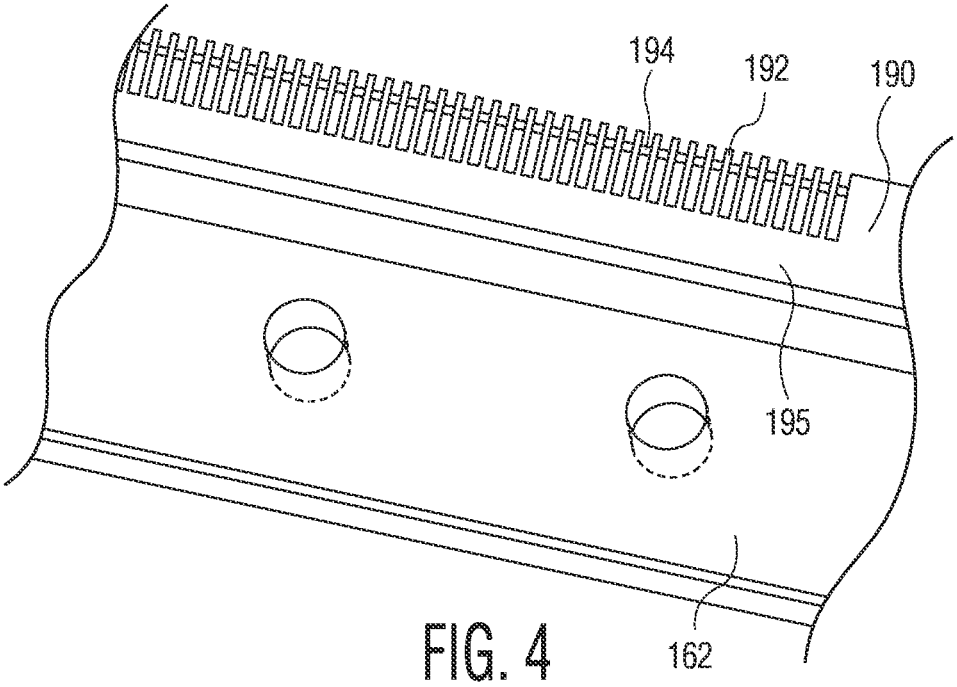
FIG. 4 is a bottom view of an anvil retention assembly.
Figure 5A:
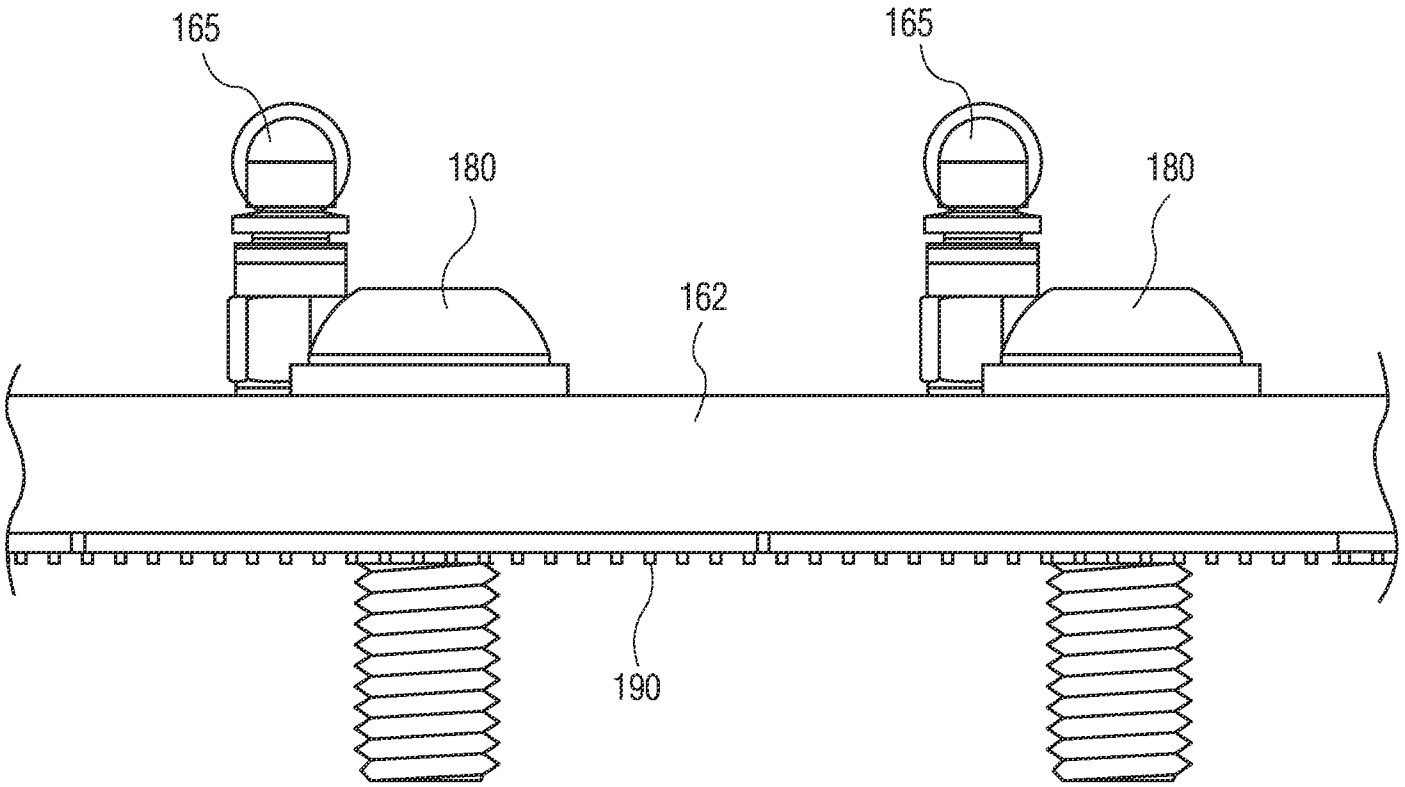
FIGS. 5A and 5B are front and cross-sectional views, respectively, of an anvil retention assembly.
Figure 5B:
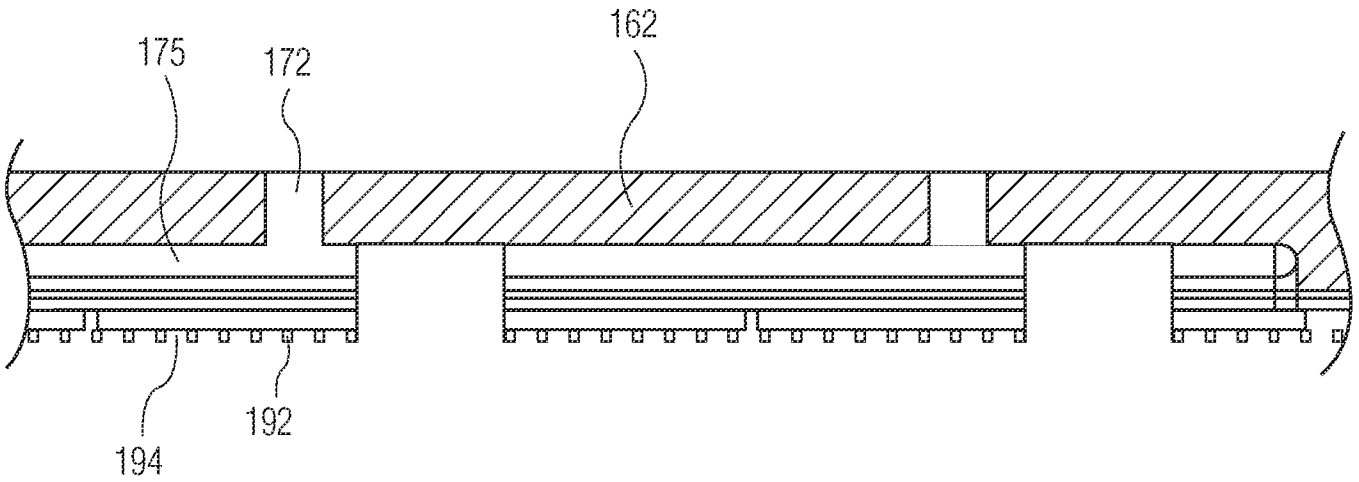

Further detail regarding the comb 190 and its plurality of comb channels 194 overlaying the plenum 175 is shown in FIGS. 3 and 4. Generally, the comb 190 is separate from the retaining member 162. The bottom surface 177 of the retaining member 162 may be machined to accommodate the comb 190, which may be a single piece of metal that extends along the longitudinal length of the retaining member 162. The comb 190 may include a portion 195 beyond the comb channels that is substantially solid to provide the comb with integrity and allow for attachment of the comb to the retention member.

It will be seen that the present invention embodies a lubricating system utilizing lubricant which is positively pumped to a plenum, which is partially sealed by a comb, causing the system to be pressurized and for lubricant to flow at a controlled rate through the comb channels and onto the anvil. In operation, the pump may operate at pressures from about 0.007 to about 0.07 bars, such as from about 0.01 to about 0.05 bars. The system has the advantage that a predetermined quantity of lubricating fluid is pumped and delivered to the anvil and then transferred to the knife blade to reduce blade wear and improve cutting.

Embodiments

First embodiment: A lubrication system for supplying a lubrication fluid to a perforating device for imparting a plurality of perforations to a tissue web, the system comprising: a rotating knife roll having at least one knife disposed thereon; an anvil roll having an anvil retention assembly comprising a retaining member having a plenum for receiving a quantity of lubricant and a comb having a plurality of comb channels, wherein the plenum and the plurality of comb channels are in fluid communication with one another; an anvil retained by the anvil retention assembly; a receptacle for storing and dispensing a lubricant; a lubricant disposed in the receptacle; and a pump.

Second embodiment: The system of the first embodiment wherein the plurality of comb channels is similarly sized and shaped.

Third embodiment: The system of the first or the second embodiment wherein the plurality of comb channels has a rectangular cross-sectional shape.

Fourth embodiment: The system of any one of the first through third embodiments wherein the plurality of comb channels have a rectangular cross-sectional shape and a substantially similar volume.

Fifth embodiment: The system of any one of the first through fourth embodiments wherein the anvil retention assembly further comprises an inlet port and a channel, the channel in fluid communication with the inlet port and the plenum.

Sixth embodiment: The system of any one of the first through fifth embodiments comprising a channel in fluid communication with the plenum.

Seventh embodiment: The system of any one of the first through sixth embodiments comprising a plurality of fasteners for securing the anvil retention assembly to the anvil roll. In certain preferred embodiments the fastener comprises a threaded bolt disposed in a hole in the anvil assembly which is received by a threaded receptacle in the anvil.

Eighth embodiment: The system of any one of the first through seventh embodiments wherein the lubricant is selected from the group consisting of polyethers, glycol, polyolefins, silicone, fluorocarbons, grease, graphite, animal oils, vegetable oils and mineral oils.

Ninth embodiment: The system of any one of the first through eighth embodiments wherein the anvil roll further comprises a shaft and the anvil roll is rotatable about the shaft.

Tenth embodiment: A lubrication system for supplying a lubrication fluid to a perforating device for imparting a plurality of perforations to a tissue web, the system comprising: a knife member; an anvil member; a lubrication device comprising a retaining member shaped to retain the knife or the anvil member, a plenum for receiving a quantity of lubricant and a comb having a plurality of comb channels, wherein the plenum and the plurality of comb channels are in fluid communication with one another; a receptacle for storing and dispensing a lubricant to the lubrication device; a lubricant disposed in the receptacle; and a pump.

Eleventh embodiment: The system of the tenth embodiment wherein the plurality of comb channels have a substantially similar shape and volume.

Twelfth embodiment: The system of any one of the tenth or eleventh embodiments wherein the lubrication device further comprises an inlet port and a channel, the channel in fluid communication with the inlet port and the plenum.

Thirteenth embodiment: The system of any one of the tenth through twelfth embodiments wherein the channel has a circular cross-sectional shape.

Fourteenth embodiment: The system of any one of the tenth through thirteenth embodiments wherein the lubricant is selected from the group consisting of polyethers, glycol, polyolefins, silicone, fluorocarbons, grease, graphite, animal oils, vegetable oils and mineral oils.

Fifteenth embodiment: The system of any one of the tenth through fourteenth embodiments wherein the knife member is stationary, and the anvil member is mounted to a rotatable anvil roll and wherein the lubrication device is attached to the knife member.

Sixteenth embodiment: The system of any one of the tenth through fifteenth embodiments wherein the anvil member is stationary, and the knife member is mounted to a rotatable knife roll and wherein the lubrication device is attached to the anvil member.

What is claimed is:

1. A lubrication system comprising:

a perforating device for imparting a plurality of perforations to a tissue web, the perforating device comprising a knife member and an anvil member;

a fluid lubricant to be supplied to the perforating device;

a lubrication device comprising a retaining member, a plenum, and a comb, the retaining member shaped to retain the knife member or the anvil member, the plenum for receiving the lubricant, and the comb having a plurality of comb channels, wherein the plenum and the plurality of comb channels are in fluid communication with one another;

a receptacle for storing and dispensing the lubricant to the lubrication device, the lubricant disposed in the receptacle; and a pump.

2. The system of claim 1 wherein the plurality of comb channels have a similar shape and volume.

3. The system of claim 1 wherein the lubrication device further comprises an inlet port and a channel, the channel in fluid communication with the inlet port and the plenum.

4. The system of claim 3 wherein the channel has a circular cross-sectional shape.

5. The system of claim 1 wherein the lubricant is selected from the group consisting of polyethers, glycol, polyolefins, silicone, fluorocarbons, grease, graphite, animal oils, vegetable oils and mineral oils.

6. The system of claim 1 wherein the anvil member is stationary, and the knife member is mounted to a rotatable knife roll and wherein the lubrication device is attached to the anvil member.

7. A lubrication system comprising:

a fluid lubricant;

a perforating device for imparting a plurality of perforations to a tissue web, the perforating device comprising a rotating knife roll and an anvil roll, the rotating knife roll having at least one knife disposed thereon, the anvil roll having an anvil retention assembly, the anvil retention assembly comprising a retaining member, the retaining member having a plenum, the plenum for receiving the lubricant, and the anvil retention assembly further comprising a comb, the comb having a plurality of comb channels, wherein the plenum and the plurality of comb channels are in fluid communication with one another, and an anvil retained by the anvil retention assembly;

a receptacle for storing and dispensing the lubricant, the lubricant disposed in the receptacle and the lubricant to be supplied to the perforating device; and a pump.

8. The system of claim 7 wherein the plurality of comb channels have a similar shape and volume.

9. The system of claim 7 wherein the anvil retention assembly further comprises an inlet port and a channel, the channel in fluid communication with the inlet port and the plenum.

10. They system of claim 7 wherein the comb contacts the anvil retention assembly and the anvil.

11. The system of claim 7 further comprising a plurality of fasteners for securing the anvil retention assembly.

12. The system of claim 7 wherein the lubricant is selected from the group consisting of polyethers, glycol, polyolefins, silicone, fluorocarbons, grease, graphite, animal oils, vegetable oils and mineral oils.

13. A method of administering a lubricant to a perforating device comprising the steps of:

a. providing the perforating device with a rotating knife roll having at least one knife disposed on the rotating knife roll;

b. providing the perforating device with an anvil roll having at least one anvil retention assembly disposed on the anvil roll, the at least one anvil retention assembly comprising a plenum, the plenum for receiving the lubricant, and the at least one anvil retention assembly further comprising a comb having a plurality of comb channels, the plurality of comb channels in fluid communication with the plenum;

c. retaining an anvil in the at least one anvil retention assembly;

d. positioning the knife roll and anvil roll to provide an operative nip region therebetween;

e. providing the lubricant to the anvil retention assembly;

f. distributing the lubricant to at least a portion of the anvil to lubricate the anvil; and g. rotating the knife roll to contact the anvil with the at least one knife to provide a selected cutting interference between the anvil and the at least one knife, whereby the lubricant is transferred to the at least one knife.

14. The method of claim 13 further comprising a step of moving a continuous target web having a machine direction, wherein the step of moving the web includes moving the web at a web speed through the nip region.

15. The method of claim 14 further comprising a step of cutting the web at intermittent locations spaced along the machine direction of the web.

16. The method of claim 13 wherein the step of providing the lubricant comprises pumping the lubricant under pressure through an inlet disposed on the anvil retention assembly.

17. The method of claim 13 wherein the step of distributing the lubricant to at least the portion of the anvil comprises flowing the lubricant from the plenum through the plurality of comb channels to the anvil.

18. The method of claim 13 wherein the lubricant is selected from the group consisting of polyethers, glycol, polyolefins, silicone, fluorocarbons, grease, graphite, animal oils, vegetable oils and mineral oils.

* * * * *